US007320368B2

(12) United States Patent
Watanabe

(10) Patent No.: US 7,320,368 B2
(45) Date of Patent: Jan. 22, 2008

(54) POWER IMPACT TOOL

(75) Inventor: Masahiro Watanabe, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 11/433,496

(22) Filed: May 15, 2006

(65) Prior Publication Data

US 2006/0254785 A1 Nov. 16, 2006

(30) Foreign Application Priority Data

May 16, 2005 (JP) ..... 2005-143310

(51) Int. Cl.
*B25D 16/00* (2006.01)

(52) U.S. Cl. ..... 173/48; 173/170; 173/201; 173/217; 310/50

(58) Field of Classification Search ..... 173/48, 173/201, 170, 217, 105; 310/47, 50
See application file for complete search history.

(56) References Cited

U.S. PATENT DOCUMENTS 3,995,703 A * 12/1976 Wanner ..... 173/105
4,085,337 A * 4/1978 Moeller ..... 307/115
5,079,459 A * 1/1992 Huston et al. ..... 310/15
5,165,488 A * 11/1992 Liu ..... 173/49
6,043,575 A * 3/2000 Ghode et al. ..... 310/52
6,487,779 B1 * 12/2002 Underthun ..... 30/277.4
6,488,195 B2 * 12/2002 White et al. ..... 227/130
6,550,356 B1 * 4/2003 Underwood ..... 81/9.22
6,763,897 B2 * 7/2004 Hanke et al. ..... 173/210

FOREIGN PATENT DOCUMENTS

JP A-2001-062756 3/2001

* cited by examiner

*Primary Examiner*—Scott A. Smith
(74) *Attorney, Agent, or Firm*—Oliff & Berridge, PLC

(57) ABSTRACT

The object of the invention is to ease of operation of the power impact tool. Such object is achieved by a representative power impact tool according to the invention including a motor, a tool bit, a trigger and a mode changing member. The trigger is manually operated by a user to control energization and non-energization of current to drive the motor. The motor is energized when the user operates the trigger to turn on and the energized state of the motor is maintained until the trigger is again operated in a same manner with the turning-on operation. According to the invention, once the trigger is depressed from the initial position to the operating position, a hammering operation can be performed by the striking movement of the tool bit without the need to lock the trigger in the operating position. Therefore, ease of operation of the hammer drill is enhanced.

8 Claims, 5 Drawing Sheets

POWER IMPACT TOOL

BACKGROUND OF THE INVENTION

1. Field of the Invention

The present invention relates to a power impact tool capable of performing a hammering operation on a workpiece by striking movement of a tool bit.

2. Description of the Related Art

Japanese non-examined laid-open Patent Publication No. 2001-62756 discloses a power impact tool capable of performing a hammering operation on a workpiece. The known power impact tool includes a tool bit, a motor for driving the tool bit, an on-off power switch for the motor, a trigger for operating the power switch, and a mode-changing member for switching between operation modes of the tool bit. Specifically, the mode-changing member can switch between a hammer mode in which the hammer bit is caused to perform striking movement and a hammer drill mode in which the hammer bit is caused to perform a combined movement of striking and rotating. The power impact tool further includes an engaging member that can releasably lock the trigger in an operating position. In order to drive the hammer bit with the mode-changing member in the hammer mode, the trigger is depressed to turn on the power switch and then locked in the operating position by the engaging member. Thus, in the hammer mode, the tool bit can be caused to perform continuous striking movement without needs of operating the trigger when the trigger is locked in the operating position by the engaging member. When the lock of the trigger by the engaging member is released, the trigger is allowed to be operated to turn the power switch on and off, so that the tool bit can be caused to perform intermittent striking movement.

However, according to the known power impact tool, in order to effect continuous hammering operation by the tool bit, the user must depress the trigger and then operate the engaging member to lock the trigger in the operating position every time when trying to drive the hammer bit. Therefore, further improvement is desired to make the operation simpler.

SUMMARY OF THE INVENTION

Accordingly, it is an object of the invention to provide a technique to improve ease of operation of the power impact tool.

The object is achieved by a representative power impact tool according to the invention including a motor, a tool bit, a trigger and a mode changing member. The tool bit is driven by the motor. The tool bit has at least a driven mode to perform a predetermined operation on a workpiece by striking movement in the axial direction of the tool bit. Further, the tool bit may preferably have another driven mode to perform a predetermined operation on a workpiece by a rotating movement on the axis of the tool bit or to perform a predetermined operation on a workpiece both by a striking movement and a rotating movement. The trigger is biased from the side of its operating position toward its initial position, while the trigger is normally held in the initial position. The trigger is manually operated by a user between the initial position and the operating position in order to control energization and non-energization of the motor. The mode changing member switches between a first mode in which the tool bit is caused to perform an operation by striking movement and a second mode in which the tool bit is caused to perform an operation by rotating movement around the axis of the tool bit solely or in addition to the striking movement.

In the power impact tool according to the invention, when the mode changing member is in the first mode position, the motor is energized by depressing the trigger from the initial position to the operating position. The energized state of the motor is maintained until the trigger is operated again after the trigger is released and returned again to the initial position. Further, when the mode changing member is in a second mode position, the motor is energized by depressing the trigger from the initial position to the operating position, and the energization of the motor is disabled when the trigger is released and returned to the initial position.

The manner in which the "trigger is operated" may preferably include the manner in which the trigger is depressed from the initial position to the operating position, the manner in which the trigger is returned from the operating position to the initial position, the manner in which the trigger is depressed from the initial position to the operating position and kept in this state for a predetermined period of time, and the manner in which the trigger is depressed from the initial position to the operating position and then returned to the initial position and this procedure is repeated several times. Therefore, the manner in which the energized state of the motor is "maintained until the trigger is operated again" includes the manner in which the energized state of the motor is maintained until the trigger is operated again in any one of the above-mentioned manners.

According to the invention, when the mode changing member is in the first mode position, the motor is energized by depressing the trigger from the initial position to the operating position, and the energized state of the motor is maintained until the trigger is operated again after the trigger is released and returned again to the initial position. In other words, according to this invention, in the first mode, once the trigger is depressed from the initial position to the operating position, a hammering operation can be performed by the striking movement of the tool bit without the need to lock the trigger in the operating position. Therefore, ease of operation of the hammer drill is enhanced. Further, the number of parts for locking the trigger can be reduced and the structure of the tool can be simplified.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved power impact tools and method for using such power impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
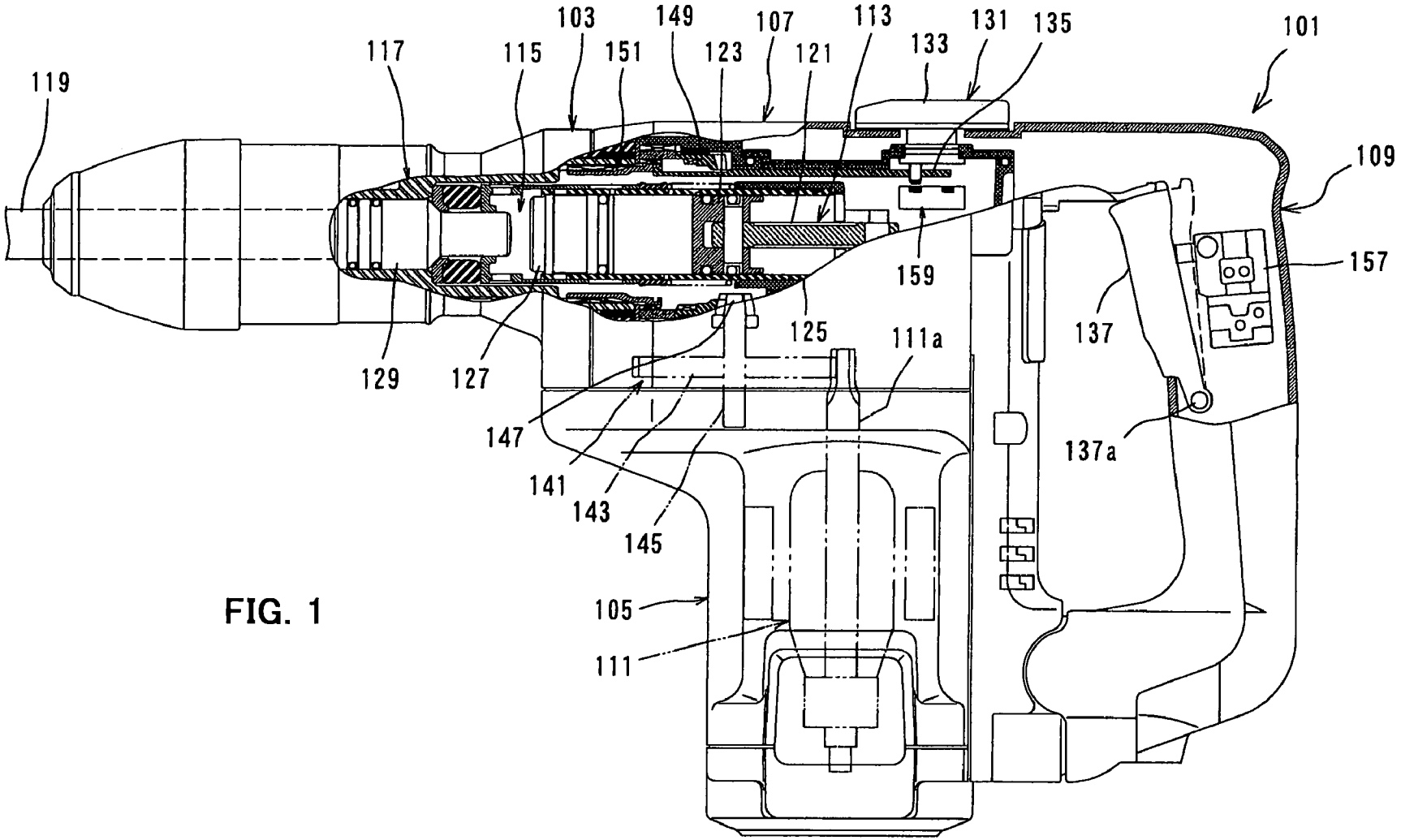
FIG. 1 is a sectional view schematically showing an entire electric hammer drill according to an embodiment of the invention.
Figure 2:
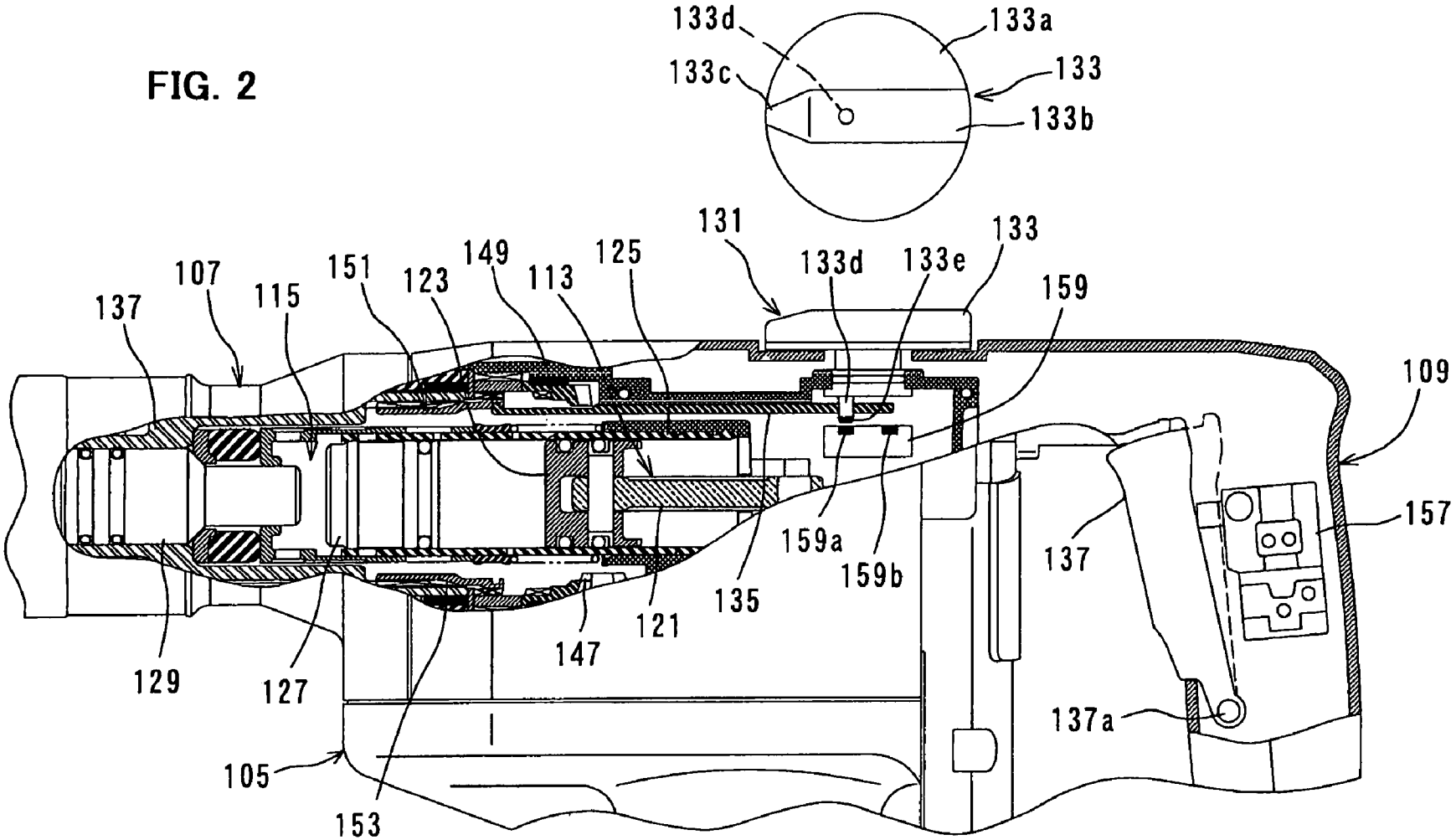
FIG. 2 is a sectional view of an essential part of the electric hammer drill, in hammer mode.
Figure 3:
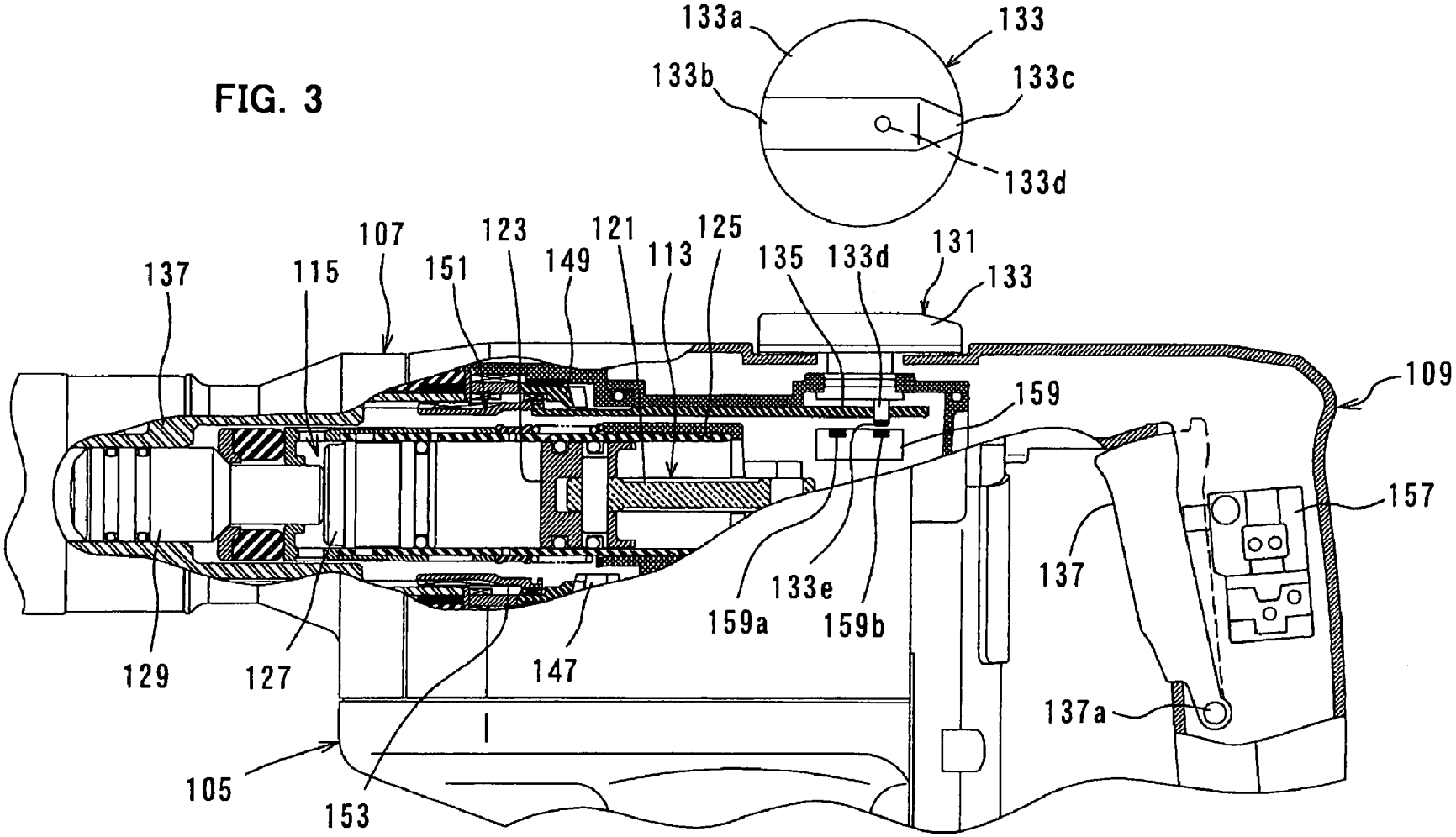
FIG. 3 is a sectional view of an essential part of the electric hammer drill, in hammer-drill mode.

A representative embodiment of the present invention will now be described with reference to FIGS. 1 to 4. FIG. 1 shows an entire electric hammer drill 101 as a representative embodiment of the power impact tool according to the present invention. FIGS. 2 and 3 show the essential part of the hammer drill 101 and a manner of switching between operation modes of a hammer bit. In FIGS. 2 and 3, a mode-changing operating member is shown in plan view in circle on the upper side of the paper. As shown in FIG. 1, the hammer drill 101 of this embodiment includes a body 103, a tool holder 117 connected to one end region (on the left side as viewed in FIG. 1) of the body 103 in the longitudinal direction of the body 103, a hammer bit 119 detachably coupled to the tool holder 117, and a grip 109 that is held by a user and connected to the other end region (on the right side as viewed in FIG. 1) of the body 103 in the longitudinal direction of the body 103. The hammer bit 119 is a feature that corresponds to the "tool bit" according to the present invention. The hammer bit 119 is held in the tool holder 117 such that it is allowed to reciprocate with respect to the tool holder 117 in its longitudinal direction (in the longitudinal direction of the body 103) and prevented from rotating with respect to the tool holder 113 in its circumferential direction.

The body 103 includes a motor housing 105 that houses a driving motor 111, a gear housing 107 that houses a motion converting mechanism 113 and a striking mechanism 115. The driving motor 111 is mounted such that a rotating shaft 111*a* of the driving motor runs generally perpendicularly to the longitudinal direction of the body 103 (vertically as viewed in FIG. 1). The motion converting mechanism 113 is adapted to convert the rotating output of the driving motor 111 to linear motion and then to transmit it to the striking mechanism 111. As a result, an impact force is generated in the axial direction of the hammer bit 119 via the striking mechanism 115.

The motion converting mechanism 113 includes a crank mechanism driven by the driving motor 111. In FIG. 1, most part of the crank mechanism is hidden by the gear housing 107, and a connecting rod 121 and a piston 123 which are arranged at the end of the movement are shown. The piston 123 comprises a driver that drives the striking mechanism 115 and can slide within a cylinder 125 in the axial direction of the hammer bit 119.

The striking mechanism 115 includes a striker 127 and an impact bolt 129. The striker 127 is slidably disposed within the bore of the cylinder 125 and linearly driven by the sliding movement of the piston 123 via the action of air spring within the cylinder bore. The impact bolt 129 is slidably disposed within the tool holder 117 and is adapted to transmit the kinetic energy of the striker 127 to the hammer bit 119.

The tool holder 113 is rotated by the driving motor 111 via a power transmitting mechanism 141. As shown in FIGS. 2 and 3, the power transmitting mechanism 141 includes an intermediate gear 143 driven by the motor 111, an intermediate shaft 145 that rotates together with the intermediate gear 143, a first bevel gear 147 that rotates together with the intermediate shaft 145, and a second bevel gear 149 that engages with the first bevel gear 147 and rotates around the axis of the body 103. The power transmitting mechanism 141 transmits rotation of the driving motor 111 to the tool holder 117. The intermediate shaft 145 is arranged parallel to the rotating shaft 111*a* of the motor 111 and perpendicularly to the longitudinal direction of the body 103.

A clutch mechanism 151 is disposed between the second bevel gear 149 and the tool holder 117 and is adapted to enable or disable the power transmitting mechanism 141 to transmit rotation of the motor 111 to the tool holder 117 via the clutch mechanism 151. The clutch mechanism 151 includes a cylindrical clutch gear 153 that is disposed movably in the longitudinal direction of the body 103. A spline shaft is formed on the outer surface of the clutch gear 153 and a spline hole is formed on the inner surface of the tool holder 117. The spline shaft engages with the spline hole, which allows the clutch gear 153 to move in the axial direction with respect to the tool holder 117 and rotate in the circumferential direction together with the tool holder 117. Clutch teeth are formed on one axial end of the clutch gear 153. The clutch teeth are engaged with or disengaged from clutch teeth of the second bevel gear 149 when the clutch gear 153 moves in the axial direction.

A mode changing mechanism 131 includes a mode-changing operating member 133 and a clutch operating member 135. The mode-changing operating member 133 is a feature that corresponds to the "mode-changing member" in this invention. The mode-changing operating member 133 is disposed on the gear housing 107 such that it can be operated from outside by the user. The mode-changing operating member 133 is mounted on the gear housing 107 such that it can be turned in a horizontal plane. As shown within a circle in FIGS. 2 and 3, the mode-changing operating member 133 has a disc 133*a* and an operating grip 133*b* on the outside of the gear housing 107. The operating grip 133*b* is provided on the upper surface of the disc 133*a* and extends in the diametrical direction of the disc. One end of the operating grip 133*b* in the diametrical direction is tapered and forms a switching position pointer 133*c*.

The clutch operating member 171 is disposed generally horizontally within the gear housing 107. One end of the clutch operating member 135 engages with the mode-changing operating member 133, and the other end extends generally horizontally toward the clutch mechanism 151. An eccentric pin 133*d* extends from the end surface of the mode-changing operating member 133 on the inside of the gear housing 107 and is disposed in a position displaced a predetermined distance from the center of rotation of the mode-changing operating member 133. One end of the clutch operating member 135 is loosely fitted onto the eccentric pin 133*d*. Thus, the clutch operating member 135 can be moved generally in its extending direction via the eccentric pin 133*d* by the user turning the mode-changing operating member 133. The other end of the clutch operating member 135 is engaged with the clutch gear 153 of the clutch mechanism 151.

When the mode-changing operating member 133 is turned to a hammer mode position (see FIG. 2), the clutch operating member 135 is caused to move via the eccentric pin 133*d* toward the tip end of the hammer bit 119 (leftward as viewed in the drawings). Thus, the clutch gear 153 moves leftward and the clutch teeth of the clutch gear 153 are disengaged from the clutch teeth of the second bevel gear 149. The hammer mode is a feature that corresponds to the "first mode" in this invention. Further, when the mode-changing operating member 133 is turned to a hammer-drill mode position (see FIG. 3), the clutch operating member 135 is caused to move via the eccentric pin 133*d* toward the grip 109 (rightward as viewed in the drawings). Thus, the clutch gear 153 moves rightward and the clutch teeth of the clutch gear 153 are engaged with the clutch teeth of the second bevel gear 149. The hammer-drill mode is a feature that corresponds to the "second mode" in this invention.

Figure 4:
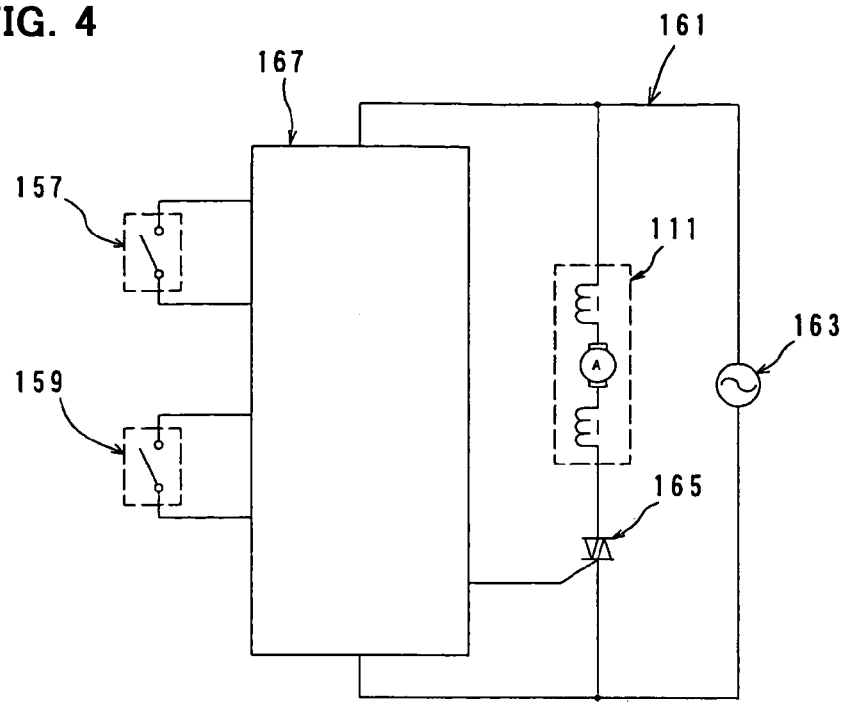
FIG. 4 is a circuit diagram of a control circuit of a driving motor.

FIG. 4 is a circuit diagram of a control circuit of a driving motor. As shown, a position detection signal of a trigger switch 157 and a position detection signal of a mode changing switch 159 are inputted to a controller 167 in the form of electric signals. The trigger switch 157 and the mode changing switch 159 are features that correspond to the "first switch" and the "second switch", respectively, in this invention. A semiconductor switch 165 is provided in a driving circuit 161 of the driving motor 111 and is operated to switch between energization and non-energization of a current to the driving motor 111. The semiconductor switch 165 is a feature that corresponds to the "third switch" in this invention. The semiconductor switch 165 is turned on and off according to directions from the controller 167, so that the driving circuit 161 is energized and non-energized. In other words, the supply of current from a power source 163 to the driving motor 111 is enabled and disabled.

A trigger 137 is mounted on the grip 109 such that it can rotate about a pivot 137*a*. The trigger switch 157 is operated via the trigger 137 (see FIGS. 1 to 3). The trigger 137 is biased from the side of its operating position toward its initial position (non-operating position) by a spring (not shown) and is normally placed in the initial position. When the trigger 137 is in the initial position, the trigger switch 157 is turned off. At this time, a signal to indicate the OFF operation of the trigger switch 157 (hereinafter referred to as "OFF signal") is inputted to the controller 167. When the trigger 137 is depressed by the user's finger from the initial position to the operating position, the trigger switch 157 is turned on. At this time, a signal to indicate the ON operation of the trigger switch 157 (hereinafter referred to as "ON signal") is inputted to the controller 167.

The mode changing switch 159 is on-off operated by operation of the mode-changing operating member 133. A part to be detected (e.g. magnet) 133*e* is provided on the end of the eccentric pin 133*d* of the mode-changing operating member 133. The mode changing switch 159 has a hammer mode detecting part 159*a* and a hammer-drill mode detecting part 159*b*. When the mode-changing operating member 133 is turned to the hammer mode position, as shown in FIG. 2, the hammer mode detecting part 159*a* faces with the part 133*e* to be detected, so that the mode changing switch 159 is placed, for example, into the on position. At this time, a signal to indicate the ON operation of the mode changing switch 159 (hereinafter referred to as "ON signal") is inputted to the controller 167. When the mode-changing operating member 133 is turned to the hammer-drill mode position, as shown in FIG. 3, the hammer-drill mode detecting part 159*b* faces with the part 133*e* to be detected, so that the mode changing switch 159 is placed into the off position. At this time, a signal to indicate the OFF operation of the mode changing switch 159 (hereinafter referred to as "OFF signal") is inputted to the controller 167.

Instead of using the above-mentioned detecting system, the mode changing switch 159 may comprise a mechanical switch which is on-off operated in association with the mode changing operation of the mode-changing operating member 133.

The controller 167 controls the on-off operations of the semiconductor switch 165 according to the inputted ON/OFF signals of the trigger switch 157 and the inputted ON/OFF signals of the mode changing switch 159, and enables or disables the supply of current (energization of a current) to the driving motor 111. Specifically, when the controller 167 receives an ON signal of the mode changing switch 159, provided that it receives an ON signal of the trigger switch 157, the controller 167 turns on (executes the ON operation of) the semiconductor switch 165 and energizes the driving circuit 161 of the motor 111. The controller 167 then keeps the energized state until it receives an OFF signal, then an ON signal again and then an OFF signal again of the trigger switch 157. Specifically, in the state in which the ON signal of the mode changing switch 159 is inputted, the controller 167 counts the number of ON signals of the trigger switch 157 (the number of times of depressing operations of the trigger 137) and the number of OFF signals of the trigger switch 157 (the number of times of releasing operations of the trigger 137). The controller 167 turns on the semiconductor switch 165 and energizes the driving circuit 161 of the motor 111 when it receives an odd-numbered ON signal of the trigger switch 157, while it keeps the semiconductor switch 165 in the ON state when it receives an even-numbered ON signal of the trigger switch 157. Further, the controller 167 keeps the semiconductor switch 165 in the ON state when it receives an odd-numbered OFF signal of the trigger switch 157, while it turns off (executes the OFF operation of) the semiconductor switch 165 and non-energizes (opens) the driving circuit 161 of the motor 111 when it receives an even-numbered OFF signal of the trigger switch 157.

Further, when the controller 167 receives an ON signal from the trigger switch 157 in the state in which an OFF signal of the mode changing switch 159 is inputted, the controller 167 turns on the semiconductor switch 165 and energizes the driving circuit 161 of the motor 111. Thereafter, when the trigger switch 157 outputs an OFF signal, the controller 167 turns off the semiconductor switch 165 and non-energizes the driving circuit 161 of the motor 111.

Figure 5:
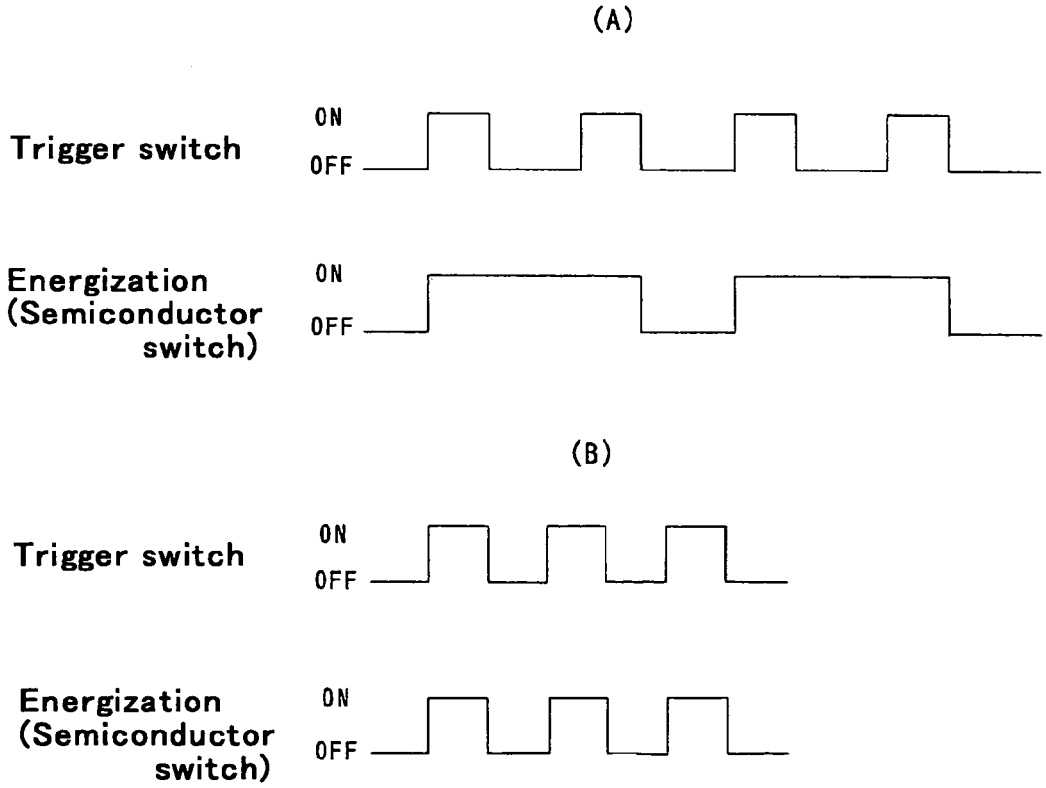
FIG. 5 shows the relationship between ON-OFF operations of a trigger switch and energization or non-energization of a current to the driving motor.

FIG. 5(A) shows the relationship between the ON-OFF operations of the trigger switch 157 and the energization and non-energization of the driving motor 111 in hammer mode. FIG. 5(B) shows the relationship between the ON-OFF operations of the trigger switch 157 and the energization and non-energization of the driving motor 111 in hammer-drill mode. Analog control, microcomputer control or any other control may be made by the controller 167 to control the energization and non-energization of the driving motor 111.

Operation and usage of the hammer drill 101 constructed as described above will now be explained.

When the user turns the mode-changing operating member 133 to the hammer mode position, as shown in FIG. 2, the clutch operating member 135 is caused to move via the eccentric pin 133*d* leftward as viewed in the drawings (toward the hammer bit 119). Thus, the clutch gear 153 also moves in this direction and the clutch teeth of the clutch gear 153 are disengaged from the clutch teeth of the second bevel gear 149. Therefore, the hammer bit 119 does not rotate in the hammer mode. Further, by thus turning the mode-changing operating member 133 to the hammer mode position, the detected part 133*e* of the eccentric pin 133*d* faces with the hammer mode detecting part 159*a*. Thus, the mode changing switch 159 is turned on and an ON signal is inputted to the controller 167. Then, the controller 167 recognizes that it has been switched to hammer mode.

In this state, when the user depresses the trigger 137 from the initial position to the operating position (first depressing operation), the trigger switch 157 is turned on and an ON signal of the trigger switch 157 is inputted to the controller 167. Then, the controller 167 turns on the semiconductor switch 165 and energizes the driving circuit 161 of the motor 111. Thus, the driving motor 111 is driven. The rotation of the motor 111 is converted into linear motion via the motion converting mechanism 113. The piston 123 of the motion converting mechanism 113 then reciprocates within the bore of the cylinder 125. The linear motion of the piston 123 is transmitted to the hammer bit 119 via the striker 127 and the impact bolt 129, so that the hammer bit 119 performs striking movement. Specifically, in the hammer mode, a hammering operation, such as chipping, can be performed solely by striking movement (hammering) of the hammer bit 119.

In this hammer mode, when the user releases the trigger 137 (first releasing operation) and the trigger 137 is returned to the initial position, the trigger switch 157 is turned off and an OFF signal of the trigger switch 157 is inputted to the controller 167. At this time, however, the semiconductor switch 165 is kept in the ON state (see FIG. 5(A)). In other words, the driving motor 111 is kept in the energized state. Therefore, the user can continuously perform the hammering operation by the hammer bit 119 with the trigger 137 held in the released state. In order to stop the hammering operation, the user depresses the trigger 137 again from the initial position to the operating position (second depressing operation) and then returns it to the initial position (second releasing operation). The controller 167 correspondingly receives an ON signal and then an OFF signal of the trigger switch 157. Then, the controller 167 turns off the semiconductor switch 165 (see FIG. 5(A)). Thus, the supply of current to the driving motor 111 is cut off. According to this embodiment, in the hammer mode, the hammering operation can be performed with ease solely by striking movement of the hammer bit 119 without the need to keep depressing the trigger 137.

In the above mentioned hammer mode, the control program of the controller 167 is designed to execute on-off control of the semiconductor switch 165 according to the amount of depression of the trigger 137. For example, when the trigger 137 is depressed beyond a specified position (for example, a midpoint in the stroke of the trigger 137) which is set between the initial position and the depressing end within its operating region, the energized state of the driving motor 111 is maintained even if the trigger 137 is thereafter released and returned to the initial position. When the trigger 137 is depressed within a range that does not go across the specified position and is thereafter released and returned to the initial position, the supply of current to the driving motor 111 is cut off.

With such construction, when the user depresses the trigger 137 beyond the specified position, the user can perform the hammering operation solely by striking movement of the hammer bit 119, by continuously driving the hammer bit 119 without the need to keep depressing the trigger 137. On the other hand, when the user depresses the trigger 137 within a range that does not go across the specified position, the user can drive or stop the hammer bit 119 by appropriately depressing or releasing the trigger 137. Therefore, the hammering operation can be performed solely by striking movement of the hammer bit 119 by intermittently driving the hammer bit 119.

In this case, it is constructed such that a feel of resistance is provided against the depressing operation of the trigger 137, for example, by friction when the trigger 137 is depressed down to the specified position. With this construction, the user can recognize the specified position by the feel of resistance when depressing the trigger 137.

Next, when the mode-changing operating member 133 is turned from the hammer mode position shown in FIG. 2 to the hammer-drill mode position shown in FIG. 3, the clutch operating member 135 is caused to move via the eccentric pin 133*d* rightward as viewed in the drawings (toward the grip 109). Thus, the clutch gear 153 also moves in this direction and the clutch teeth of the clutch gear 153 are engaged with the clutch teeth of the second bevel gear 149. Further, by thus turning the mode-changing operating member 133 to the hammer-drill mode, the detected part 133*e* of the eccentric pin 133*d* faces with the hammer-drill mode detecting part 159*b*. Thus, the mode changing switch 159 is turned off and an OFF signal is inputted to the controller 167. Then, the controller 167 recognizes that it has been switched to hammer-drill mode.

In this state, when the user depresses the trigger 137 from the initial position to the operating position, the trigger switch 157 is turned on and an ON signal of the trigger switch 157 is inputted to the controller 167. Then, the controller 167 turns on the semiconductor switch 165 and energizes the driving circuit 161 of the motor 111. Thus, the driving motor 111 is driven. The rotation of the motor 111 is converted into linear motion via the motion converting mechanism 113. Then, the linear motion is transmitted to the hammer bit 119 via the striker 127 and the impact bolt 129 which form the striking mechanism 115. Further, the rotation of the driving motor 111 is transmitted as rotation to the tool holder 117 and the hammer bit 119 (which is supported by the tool holder 117 such that the hammer bit 119 is prevented from rotating with respect to the tool holder 117) via the power transmitting mechanism 141. Specifically, the hammer bit 119 is driven by striking (hammering) movement and rotating (drilling) movement. Thus, a predetermined hammer-drill operation can be performed on the workpiece.

In this hammer-drill mode, when the user releases the trigger 137 and the trigger 137 is returned to the initial position, the trigger switch 157 is turned off and an OFF signal of the trigger switch 157 is inputted to the controller 167. Then, a signal is outputted from the controller 167 in order to turn off the semiconductor switch 165. Thus, the semiconductor switch 165 is turned off and the supply of current to the driving motor 111 is cut off (see FIG. 5(B)). Thus, the motor 111 stops driving. Specifically, in the hammer-drill mode, the user can drive and stop the hammer bit 119 by depressing and releasing the trigger 137. Thus, the hammer-drill operation can be performed by the striking and rotating movement of the hammer bit 119 by intermittently driving the hammer bit 119.

According to this embodiment, in the hammer mode, when the trigger 137 is depressed from the initial position to the operating position, the driving motor 111 is energized. This energized state is maintained until the trigger 137 is depressed again to the operating position and then returned to the initial position after the trigger 137 is released and returned to the initial position. Specifically, once the trigger 137 is depressed from the initial position to the operating position, a hammering operation can be performed by the striking movement of the hammer bit 119 without the need to lock (hold) the trigger 137 in the operating position. Therefore, ease of operation of the hammer drill 101 is enhanced compared with the prior art impact power tool in which the user needs to perform two operations of depressing the trigger and locking the trigger in the operating position every time when trying to drive the hammer bit.

Further, according to this embodiment, in the hammer mode, the hammer operation can be stopped by returning the trigger 137 to the initial position (odd-numbered releasing operation). Therefore, in order to stop the operation, the trigger 137 can be operated in the same manner as in the hammer-drill mode. Thus, the trigger 137 can be used with ease in a natural manner.

Further, according to this embodiment, a mechanical locking mechanism for locking the trigger 137 in the operating position is not provided. Therefore, compared with the prior art power impact tool, the number of parts can be reduced, and the structure can be effectively simplified. Further, such a construction allows provision of a vibration-proof grip. Vibration is caused in the body 103 of the hammer drill 101 when the hammer drill 101 is driven. Therefore, in order to prevent or reduce such vibration from being transmitted to the grip 109, the vibration-proof grip is constructed by coupling the grip 109 to the body 103 via an elastic element, such as a spring or rubber, such that it can move with respect to the body 103 at least in the axial direction (the direction of striking movement) of the hammer bit 119. Provision of both the vibration-proof grip and the mechanical locking mechanism for locking the trigger 137 in the operating position is technically very difficult or impossible. According to this embodiment, however, the same effect as the mechanical locking mechanism can be electrically realized, which allows provision of the vibration-proof grip.

Figure 6:
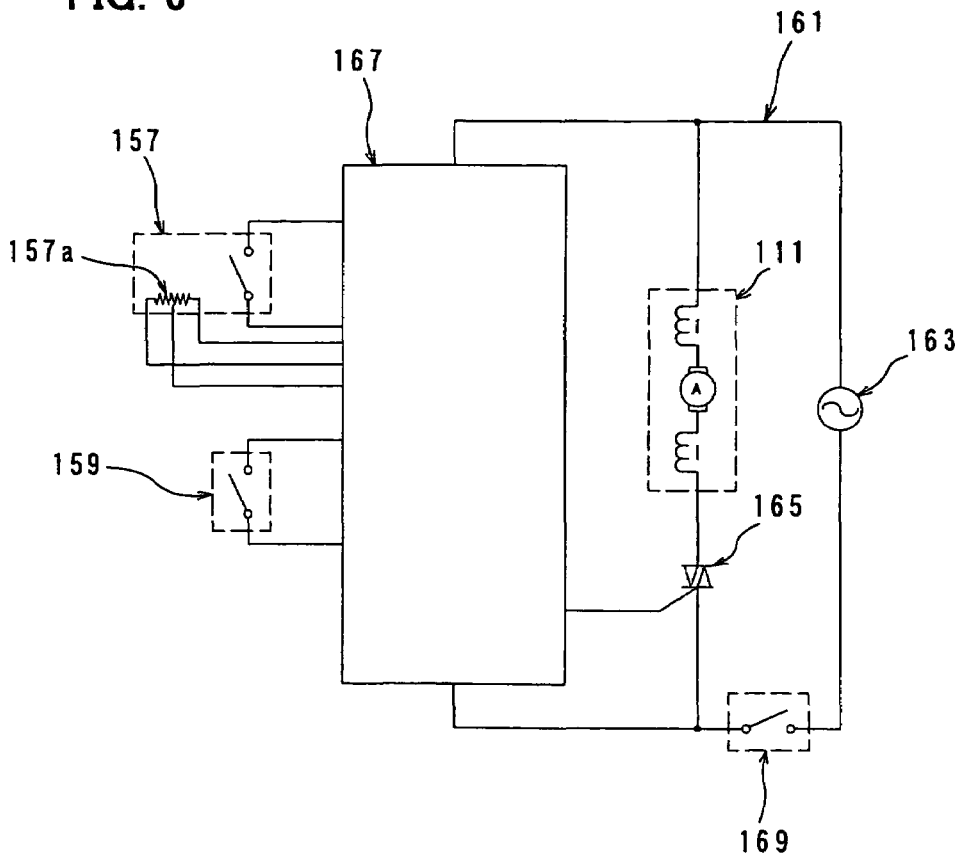
FIG. 6 is a circuit diagram showing a modification of the control circuit of the driving motor.

FIG. 6 shows a modification of the motor control circuit for controlling the driving motor 111 in this embodiment. In this modification, a manual on-off switch 169 which can be operated by the user is additionally provided in the driving circuit 161 of the motor 111. Further, the trigger switch 157 which is actuated by the trigger 137 is provided with a resistor 157*a*. The trigger switch 157 with the resistor 157*a* is turned on by depressing the trigger 137. Further, the voltage input to the controller 167 varies according to the amount of depression of the trigger 137. The controller 167 varies the voltage to be supplied to the driving motor 111 according to the voltage input from the trigger switch 157 and thus controls the number of revolutions (rotational speed) of the driving motor 111. Specifically, the number of revolutions of the driving motor 111 increases as the amount of depression of the trigger 137 increases.

Further, in this modification, the controller 167 is designed to control such that the rotational speed of the driving motor 111 reaches the maximum speed when the trigger 137 is depressed from the initial position toward the operating position and reaches a position near a specified position (for example, a midpoint in the stroke of the trigger 137) or a near position before the specified position. Further, the controller 167 is designed to control the semiconductor switch 165 according to the amount of depression of the trigger 137. Specifically, when the trigger 137 is depressed beyond the specified position, the controller 167 keeps the driving motor 111 in the energized state driven at the maximum rotational speed even if the trigger 137 is thereafter released and returned to the initial position. When the trigger 137 is depressed within a range that does not go across the specified position and is thereafter released and returned to the initial position, the supply of current to driving motor 111 is cut off.

According to the modification having the above-mentioned construction, when the user depresses the trigger 137 beyond the specified position, even if the trigger 137 is thereafter released, the semiconductor switch 165 is kept in the ON state and the driving motor 111 is kept in the energized state driven at the maximum rotational speed. Therefore, the user can perform the hammering operation by striking movement of the hammer bit 119, by continuously driving the hammer bit 119 without the need to keep depressing the trigger 137. On the other hand, when the user depresses the trigger 137 within a range that does not go across the specified position, the user can stop or drive the hammer bit 119 at a rotational speed appropriate to the amount of depression of the trigger 137, by appropriately depressing or releasing the trigger 137. Therefore, the hammering operation can be performed by striking movement of the hammer bit 119 by intermittently driving the hammer bit 119 at a predetermined speed.

Further, according to the modification, when the trigger 137 is depressed from the initial position toward the operating position and reaches a position near the specified position, the driving motor 111 is driven at the maximum rotational speed. Therefore, either in the manner in which the trigger 137 is depressed beyond the specified position or in the manner in which the trigger 137 is depressed within a range that does not go across the specified position, hammering operation can be performed with the driving motor 111 kept driven at the maximum rotational speed. Thus, the working efficiency can be enhanced.

In this case, it is constructed such that a feel of resistance is provided against the depressing operation of the trigger 137, for example, by friction when the trigger 137 is depressed to a position near the specified position or to the specified position. With this construction, when depressing the trigger 137, the user can recognize by the feel of resistance that the trigger 137 has been depressed to the position near the specified position or to the specified position within the stroke of the trigger 137.

Further, in this modification, the provision of the on-off switch 169 in the driving circuit 161 of the motor 111 allows the user to stop the motor 111 as necessary.

Figure 7:
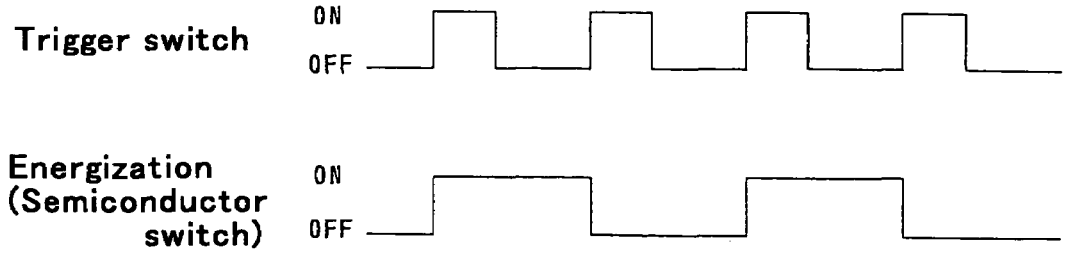
FIG. 7 shows a modification with respect to the relationship between ON-OFF operations of the trigger switch and energization or non-energization of a current to the driving motor.

Further, in this embodiment, in order to stop the hammering operation of the hammer drill 101 being driven in the hammer mode, as shown in FIG. 5(A), the trigger 137 held in the initial position is depressed again to the operating position and then returned to the initial position again. At this time, the supply of current to the driving motor 111 is cut off. Instead of such construction, as shown in FIG. 7, it may be constructed such that the supply of current to the driving motor 111 is cut off when the trigger 137 is depressed again from the initial position to the operating position. Specifically, the controller 167 controls such that, with the semiconductor switch 165 held in the ON state, or with the motor 111 held in the energized state, when the trigger 137 is depressed again from the initial position to the operating position and the trigger switch 157 is turned on, the semiconductor switch 165 is turned off.

Further, in this embodiment, the present invention has been described as being applied to the hammer drill 101 which is capable of switching between hammer mode and hammer-drill mode as the operation modes of the hammer bit 119. However, this invention may also be applied to an electric hammer drill which is capable of switching to additional modes, such as a drill mode in which the hammer bit 119 is caused to perform only a rotating movement and a neutral mode in which the hammer bit 119 does not operate even if the trigger 137 is depressed. In this case, in the drill mode, the controller 167 controls the energization and non-energization of the driving motor 111 via the semiconductor switch 165 in the same manner as in the hammer-drill mode.

Further, in this embodiment, the semiconductor switch 165 has been described as being used as a switch disposed in the driving circuit 161 of the motor 111, but it is not limited to the semiconductor switch 165. Any switch can be used which is disposed in the driving circuit 161 of the motor 111 and can energize and non-energize the driving circuit 161 by turning on and off.

Description of Numerals

101 electric hammer drill (power impact tool)
103 body
105 motor housing
107 gear housing
109 grip
111 driving motor (motor)
111*a* rotating shaft
113 motion converting mechanism
115 striking mechanism
117 tool holder
119 hammer bit (tool bit)
121 connecting rod
123 piston
125 cylinder
127 striker
129 impact bolt
131 mode-changing mechanism
133 mode-changing operating member
133*a* disc
133*b* operating grip
133*c* switching position pointer
133*d* eccentric pin
133*e* part to be detected
135 clutch operating member
137 trigger
137*a* pivot
141 power transmitting mechanism
143 intermediate gear
145 intermediate shaft
147 first bevel gear
149 second bevel gear
151 clutch mechanism
153 clutch gear
157 trigger switch (first switch)
157*a* resistor
159 mode changing switch (second switch)
159*a* hammer mode detecting part
159*b* hammer-drill mode detecting part
161 driving circuit
163 power source
165 semiconductor switch (third switch)
167 controller
169 on-off switch

I claim:

1. A power impact tool comprising:

a motor, a tool bit driven by the motor, the tool bit having at least a driven mode to perform a predetermined operation on a workpiece by a striking movement in an axial direction of the tool bit, a trigger manually operated by a user of the power impact tool to control energization and non-energization of current to drive the motor, wherein the motor is energized when the user operates the trigger to turn on and the energized state of the motor is maintained until the trigger is again operated in a same manner with the turning-on operation, wherein the trigger has a operating position and an initial position, wherein the trigger is biased from the operating position toward the initial position and is normally held in the initial position, the trigger being operated by a user of the power impact tool between the initial position and the operating position to control energization and non-energization of current to the motor, the power impact tool further comprising a mode changing member manually switched by the user between a first mode in which the tool bit performs a striking movement and a second mode in which the tool bit performs a rotating movement around the axis of the tool bit in addition to or instead of the striking movement wherein, when the mode changing member is located in the first mode position, the motor is energized by depressing the trigger from the initial position to the operating position and the energized state of the motor is maintained until the trigger is operated again after the trigger is released and returned again to the initial position and when the mode changing member is located in the second mode position, the motor is energized by depressing the trigger from the initial position to the operating position and the energization of the motor is disabled when the trigger is released and returned to the initial position.

2. The power impact tool as defined in claim 1 further comprising a driving circuit for the motor, wherein the motor is energized by the driving circuit when the user operates the trigger to turn on and the driving circuit maintains the energized state of the motor until the trigger is again operated in a same manner with the turning-on operation, while allowing the trigger being returned to an initial position during maintaining the energized state of the motor.

3. The power impact tool as defined in claim 1 further comprising a driving circuit for the motor wherein:

when the mode changing member is located in the first mode position, the driving circuit energizes the motor according to the user depressing the trigger from the initial position to the operating position and the driving circuit maintains the energized state of the motor until the trigger is operated again after the trigger is released and returned again to the initial position and, when the mode changing member is located in the second mode position, the driving circuit energizes the motor according to the user depressing the trigger from the initial position to the operating position and the driving circuit disables the energization of the motor when the trigger is released and returned to the initial position.

4. The power impact tool as defined in claim 1, wherein, when the mode changing member is located in the first mode position, the motor is energized by depressing the trigger from the initial position to the operating position, and at this time, when the trigger is depressed beyond a specified position which is set between the initial position and a depressing end within an operating region of the trigger, the motor is kept in the energized state even if the trigger is thereafter released and returned to the initial position, while, when the trigger is depressed within a range that does not go across the specified position and is thereafter released and returned to the initial position, the energization of the driving motor is disabled.

5. The power impact tool as defined in claim 1, wherein, when the mode changing member is located in the first mode position, the motor is energized by depressing the trigger from the initial position to the operating position, and at this time, the rotational speed of the motor increases as the amount of depression of the trigger increases, and the rotational speed of the motor reaches the maximum speed when the trigger is depressed down to a position near a specified position which is set between the initial position and a depressing end within the operating region of the trigger, and when the trigger is further depressed beyond the specified position, the driving motor is kept in the energized state driven at the maximum rotational speed even if the trigger is thereafter released and returned to the initial position, while, when the trigger is depressed within a range that does not go across the specified position and is thereafter released and returned to the initial position, the energization of the motor is disabled.

6. The power impact tool as defined in claim 1 further comprising:

a first switch that outputs a detection signal in the form of an electric signal to detect whether the trigger is in the initial position or in the operating position, a second switch that outputs a detection signal in the form of an electric signal to detect whether the mode changing member is in the first mode position or in the second mode position, a third switch that is provided in a driving circuit of the motor and is turned on and off to energize and non-energize the driving circuit and a controller which receives the electric signals from the first and the second switches and controls the on-off operation of the third switch according to the received electric signals, wherein:

when the second switch outputs a signal that the mode changing member is located in the first mode position and the first switch outputs a signal that the trigger is in the operating position, the controller turns on the third switch and energizes the driving circuit of the motor, and the controller keeps the third switch in the on state until the first switch changes to a signal that the trigger is located in the initial position and to the operating position and again to the initial position and when the electric signal of the second switch outputs a signal that the mode changing member is located in the second mode position and the first switch outputs a signal that the trigger is located in the operating position, the controller turns on the third switch and energizes the driving circuit of the motor, and when the first switch thereafter outputs a signal that the trigger is located in the initial position, the controller turns off the third switch and non-energizes the driving circuit of the motor.

7. The power impact tool as defined in claim 1 further comprising a controller of the motor:

wherein, when the mode changing member is located in the first mode position, the controller respectively counts the number of times of depressing operations of the trigger and the number of times of releasing operations of the trigger, the controller energizes the motor when odd-numbered depressing operations of the trigger are counted and the controller keeps the energized state when even-numbered depressing operations of the trigger are counted, while the controller keeps energized state of the motor when odd-numbered releasing operations of the trigger are counted and turns off the energized state of the motor when even-numbered releasing operations of the trigger are counted.

8. The power impact tool as defined in claim 1 further comprising:

a body that houses the motor, a grip which the user of the power impact tool holds, an elastic element provided between the body and an upper end region of the grip, the elastic element elastically coupling the grip to the body, wherein the trigger is located in the upper region of the grip or in the vicinity of the upper region of the grip.

* * * * *